US010851522B2

(12) United States Patent
Kamiya et al.

(10) Patent No.: US 10,851,522 B2
(45) Date of Patent: Dec. 1, 2020

(54) WORK VEHICLE

(71) Applicant: Hitachi Construction Machinery Co., Ltd., Tokyo (JP)

(72) Inventors: Jumpei Kamiya, Akashi (JP); Hideyuki Tanaka, Akashi (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 135 days.

(21) Appl. No.: 16/092,234

(22) PCT Filed: Mar. 2, 2017

(86) PCT No.: PCT/JP2017/008377
§ 371 (c)(1),
(2) Date: Oct. 9, 2018

(87) PCT Pub. No.: WO2018/034017
PCT Pub. Date: Feb. 22, 2018

(65) Prior Publication Data

US 2020/0087892 A1 Mar. 19, 2020

(30) Foreign Application Priority Data

Aug. 17, 2016 (JP) ..... 2016-160039

(51) Int. Cl.
*E02F 9/22* (2006.01)
*E02F 3/43* (2006.01)
(Continued)

(52) U.S. Cl.
CPC ..... *E02F 9/2242* (2013.01); *E02F 3/431* (2013.01); *E02F 9/2246* (2013.01);
(Continued)

(58) Field of Classification Search
CPC ..... E02F 9/22; E02F 9/2242; E02F 9/2292; F15B 11/162; F15B 11/17; F15B 13/022
See application file for complete search history.

(56) References Cited

U.S. PATENT DOCUMENTS 7,178,333 B2 * 2/2007 Oka ..... E02F 9/2239 60/421
9,145,660 B2 * 9/2015 Peterson ..... E02F 9/2235
(Continued)

FOREIGN PATENT DOCUMENTS

EP 2 905 385 A1 8/2015
JP 07/76859 A 3/1995
JP 2015-158099 A 9/2015

OTHER PUBLICATIONS

International Search Report of PCT/JP2017/008377 dated Apr. 11, 2017.

*Primary Examiner* — Michael Leslie
*Assistant Examiner* — Matthew Wiblin
(74) *Attorney, Agent, or Firm* — Mattingly & Malur, PC

(57) ABSTRACT

The work vehicle includes: a working device; an auxiliary machine; and a priority valve that is switched between a normal position for directing pressure oil from an accessory pump toward the auxiliary machine and a merging position for directing the pressure oil from the accessory pump toward the working device. The work vehicle includes a control device that holds the priority valve in the normal position in case either the forward direction or the reverse direction which is indicated by a forward reverse operating device and a travel direction of the work vehicle do not match each other, and that switches the priority valve to the merging position in case either the forward direction or the reverse direction which is indicated by the forward reverse
(Continued)

operating device and a travel direction of the work vehicle match each other and an operating device is in an operated state.

5 Claims, 13 Drawing Sheets

(51) Int. Cl.
*F02D 29/04* (2006.01)
*F15B 13/02* (2006.01)

(52) U.S. Cl.
CPC ..... *E02F 9/2292* (2013.01); *F02D 29/04* (2013.01); *F15B 13/022* (2013.01); *F15B 2211/20523* (2013.01); *F15B 2211/20576* (2013.01); *F15B 2211/4053* (2013.01); *F15B 2211/7142* (2013.01)

(56) References Cited

U.S. PATENT DOCUMENTS 10,385,545 B2 * 8/2019 Kamoshita ..... E02F 9/2242
2003/0037465 A1 * 2/2003 Toji ..... E02F 9/2239 37/348
2006/0090949 A1 * 5/2006 Binev ..... F15B 21/14 180/305
2009/0057049 A1 * 3/2009 Yamada ..... F16H 61/456 180/307
2010/0071359 A1 * 3/2010 Kure ..... F16H 59/72 60/428
2012/0152641 A1 * 6/2012 Takahashi ..... F16H 61/4017 180/307
2014/0366517 A1 * 12/2014 Sohn ..... E02F 9/2282 60/428
2015/0176251 A1 * 6/2015 Lee ..... E02F 9/26 60/327

* cited by examiner

WORK VEHICLE

TECHNICAL FIELD

The present invention relates to work vehicles.

BACKGROUND ART

Work vehicles are known that merge hydraulic oil discharged from an auxiliary-machine accessory pump with hydraulic oil discharged from a main pump, and then supply the resulting fluid to an arm cylinder (boom cylinder) in order to increase the operating speed of an arm (boom) (see Patent Literature 1).

CITATION LIST

Patent Literature

PATENT LITERATURE 1: JP-A No. 2015-158099

SUMMARY OF INVENTION

Technical Problem

In the work vehicles such as a wheel loader and the like, depending on operation of the work vehicle, upon execution of control to merge the hydraulic oil discharged from the accessory pump with the hydraulic oil discharged from the main pump, an increase in load acting on the engine causes a phenomenon called "lug down" in which the engine rotation speed temporarily drops. This may result in awkward or jerky movement of the vehicle to cause extreme discomfort to the driver.

Solution to Problem

A work vehicle according to an aspect of the present invention includes: a main pump and an accessory pump that are driven by an engine; a working device that is driven by pressure oil discharged from the main pump; an operating device that operates the working device; an auxiliary machine that is driven by pressure oil discharged from the accessory pump; a priority valve that is switched between a normal position and a merging position, the normal position directing toward the auxiliary machine the pressure oil discharged from the accessory pump, the merging position directing toward the working device the pressure oil discharged from the accessory pump; and a forward reverse operating device that indicates which of a forward direction and a reverse direction the work vehicle is caused to travel in. The work vehicle includes a control device that holds the priority valve in the normal position in case either the forward direction or the reverse direction which is indicated by the forward reverse operating device and a travel direction of the work vehicle do not match each other, and that switches the priority valve to the merging position in case either the forward direction or the reverse direction which is indicated by the forward reverse operating device and a travel direction of the work vehicle match each other and the operating device is in an operated state.

Advantageous Effects of Invention

According to the present invention, the smooth movement of the work vehicle can be achieved by avoiding lug down.

BRIEF DESCRIPTION OF DRAWINGS

FIG. 9 is a diagram illustrating V-shape loading which is one of methods of loading a damp truck with earth, sand and/or the like.

DESCRIPTION OF EMBODIMENTS

An embodiment of a work vehicle according to the present invention will now be described with reference to the drawings.

Figure 1:
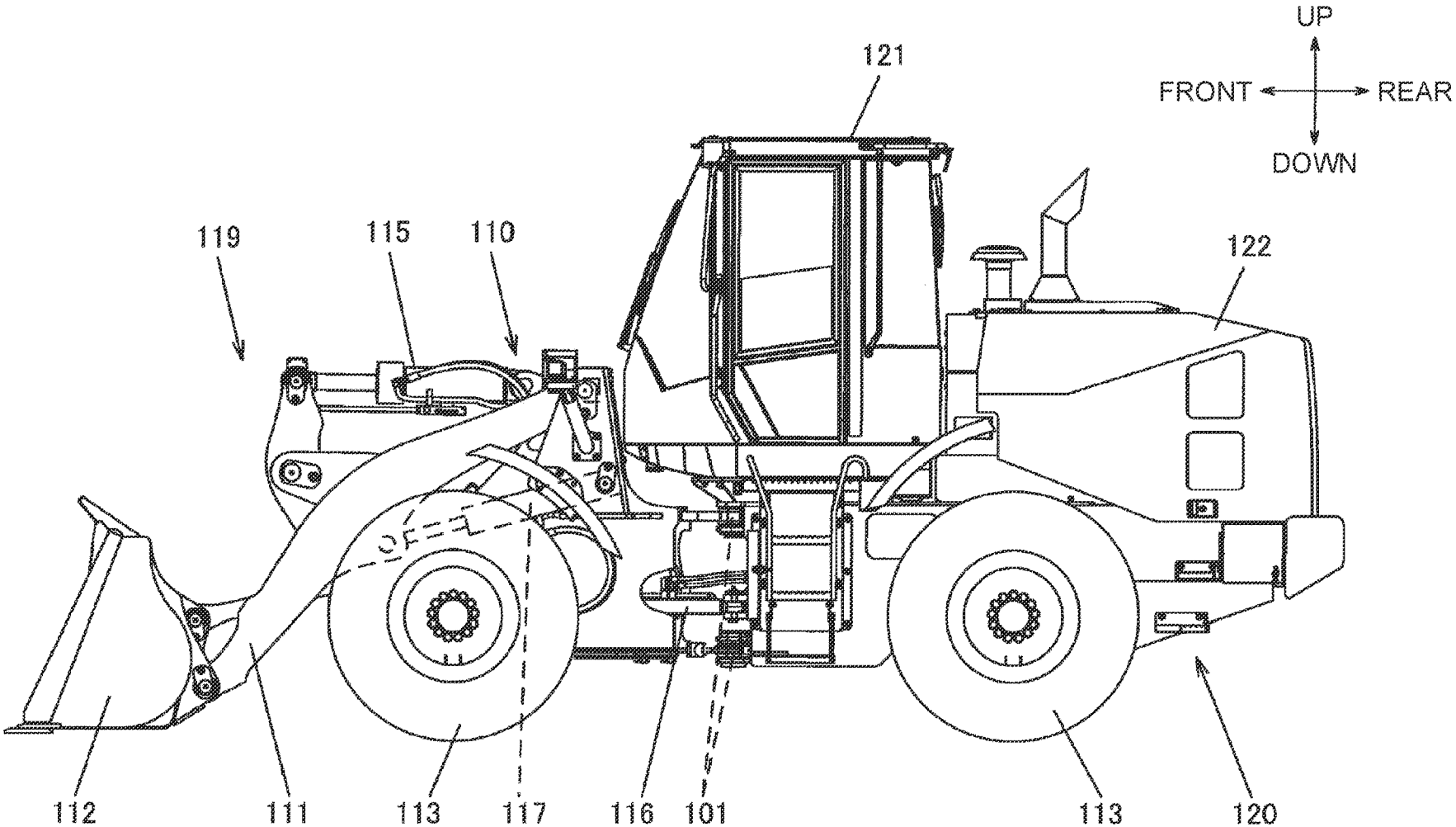
FIG. 1 is a side view of a wheel loader which is an example work vehicle according to one embodiment of the present invention.

FIG. 1 is a side view of a wheel loader which is an example work vehicle according to one embodiment of the present invention. The wheel loader includes: a front frame 110 having an arm (also called a lift arm or a boom) 111, a bucket 112, wheels 113 (front wheels) and the like; and a rear frame 120 having a cab 121, a machine compartment 122, wheels 113 (rear wheels) and the like.

The arm 111 is rotated in the vertical direction (raised/lowered) by driving of an arm cylinder 117. The bucket 112 is rotated in the vertical direction (crowd/dump) by driving of a bucket cylinder 115. A front working device (working system) 119, which is used for excavation work, loading/unloading work and the like, is configured to include the arm 111, the arm cylinder 117, the bucket 112, and the bucket cylinder 115. The front frame 110 and the rear frame 120 are rotatably coupled to each other through a center pin 101, and the front frame 110 is moved to be bent relative to the rear frame 120 by the extension and contraction of a steering cylinder 116.

An engine is installed in the machine compartment 122, and various operating devices are installed in the cab 121, such as an accelerator pedal, an arm operating device, a bucket operating device, a steering device, a forward reverse shift lever, and the like.

Figure 2:
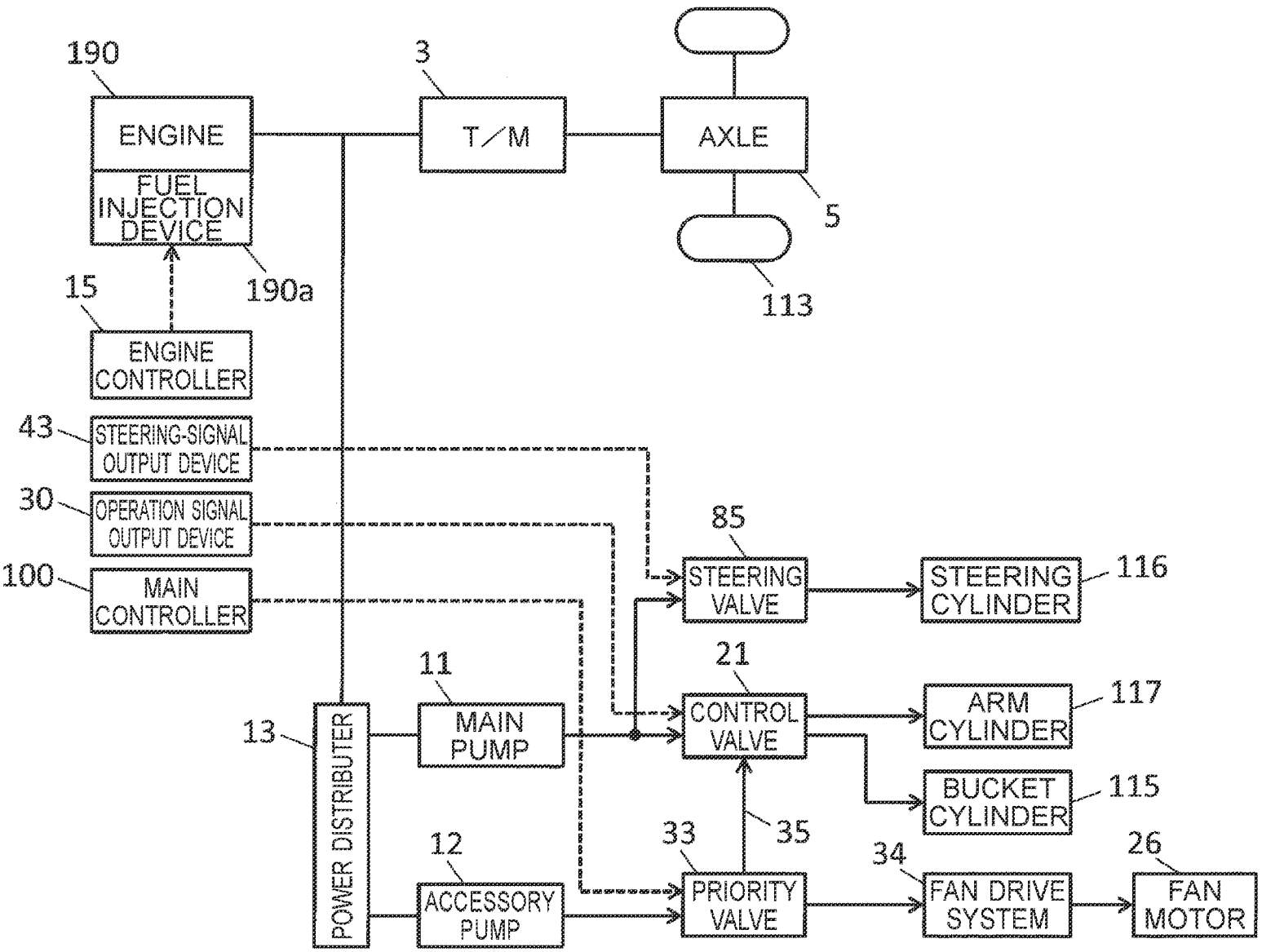
FIG. 2 is a schematic diagram illustrating the configuration of the wheel loader.

FIG. 2 is a schematic diagram illustrating the configuration of the wheel loader. The arm operating device operating the arm 111 and the bucket operating device operating the bucket 112 each include a rotatably operable lever, and an operation signal output device 30 that outputs an operation signal in response to the lever manipulated variable. The operation signal output device 30 has a plurality of pilot valves, and outputs a pilot pressure which is an operation signal corresponding to an instruction to raise the arm 111, an instruction to lower the arm 111, a crowd instruction for the bucket 112 or a dump instruction for the bucket 112.

The steering device includes a rotatably operable steering wheel, and a steering signal output device 43 outputting a steering signal in response to the steering-wheel manipulated variable. The steering signal output device 43 is e.g., Orbitrol®, and is coupled to the steering wheel through a steering shaft and outputs a pilot pressure which is a steering signal corresponding to a left turn instruction or a right turn instruction.

The wheel loader includes control devices such as a main controller 100, an engine controller 15 and the like. The main controller 100 and the engine controller 15 are configured to include a CPU, a storage device such as ROM, RAM and/or the like, and an arithmetic processing device having other peripheral circuits and/or the like, and controls each component (a hydraulic pump, a valve, the engine and the like) of the wheel loader.

The wheel loader includes a travel drive device (traveling system) that transfers the drive power of an engine 190 to the wheels 113. It is noted that a main pump 11 and an accessory pump 12 which will be described later are connected to the engine 190 through a power distributor 13. The travel drive device includes a transmission 3 coupled to the output shaft of the engine 190 and an axle device 5 coupled to the output shaft of the transmission 3.

Figure 3:
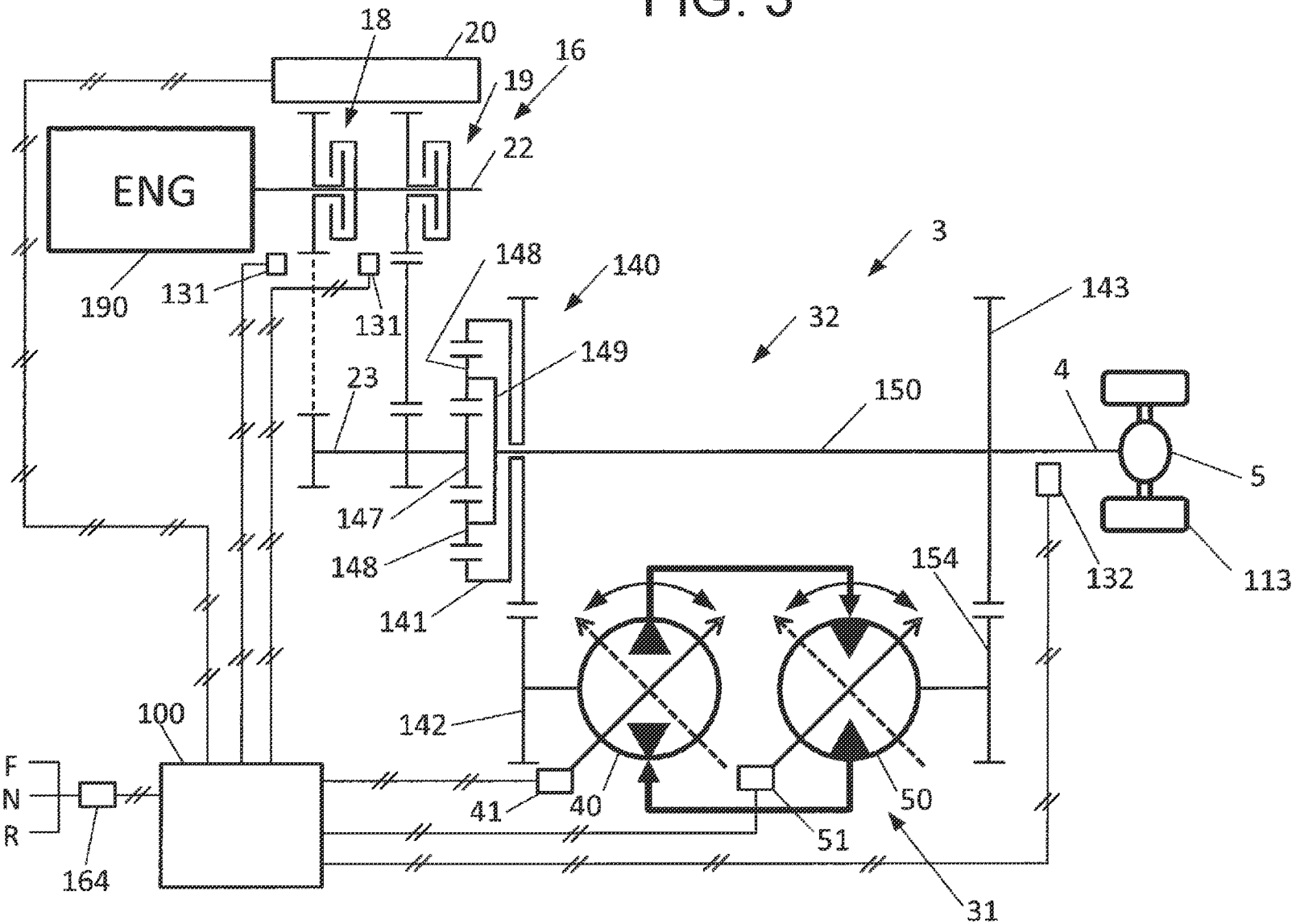
FIG. 3 is a schematic diagram illustrating the configuration of a transmission.

FIG. 3 is a schematic diagram illustrating the configuration of the transmission 3. The transmission 3 is a HMT (Hydro-Mechanical Transmission), and includes a HST (Hydro Static Transmission) 31 and a mechanical transmission unit 32, and the drive power of the engine 190 is transferred to the HST 31 and the mechanical transmission unit 32 in parallel. The rotation of the output shaft of the engine 190 is varied in speed through the transmission 3. The rotation after its speed has been changed is transferred to the wheels 113 through an output shaft 4 and the axle device 5 in order for the wheel loader to travel.

The transmission 3 includes a clutch device 16 having a forward hydraulic clutch (hereinafter referred to as a "forward clutch 18") and a reverse hydraulic clutch (hereinafter referred to as a "reverse clutch 19"), and provides shift between forward and reverse on the basis of an instruction from a forward reverse shift lever 164. The forward clutch 18 and the reverse clutch 19 perform engagement (connection) operation upon a rise in pressure (clutch pressure) of the pressure oil supplied through a transmission control device 20, and perform release (disengagement) operation upon a drop in clutch pressure.

The output shaft of the engine 190 is coupled to a clutch shaft 22. Where the forward clutch 18 is in the engagement state, the reverse clutch 19 is in the release state, and thus the clutch shaft 22 rotates integrally with the forward clutch 18 to cause the wheel loader to travel in the forward direction. Where the reverse clutch 19 is in the engagement state, the forward clutch 18 is in the release state, and thus the clutch shaft 22 rotates integrally with the reverse clutch 19 to cause the wheel loader to travel in the reverse direction.

The torque of the clutch shaft 22 is transferred through a gear to the input shaft 23. A sun gear 147 of a planetary gear mechanism 140 is fixed to the input shaft 23. A plurality of planet gears 148 meshes with the outer periphery of the sun gear 147. Each of the planet gears 148 is axially supported by a planetary carrier 149, and in turn the planetary carrier 149 is fixed to an output shaft 150. The output shaft 150 is connected to the above-described output shaft 4. A ring gear 141 meshes with the outer periphery of the planet gear group, and in turn a pump input gear 142 meshes with the outer periphery of the ring gear 141. The pump input gear 142 is fixed to a rotation shaft of a travel hydraulic pump (hereinafter referred to as a "HST pump 40"). The HST pump 40 is connected in closed circuit to a travel hydraulic motor (hereinafter referred to as a "HST motor 50"). A motor output gear 154 is fixed to a rotation shaft of the HST motor 50, and the motor output gear 154 meshes with a gear 143 of the output shaft 150.

The HST pump 40 is a swash-plate or bent-axis, variable displacement hydraulic pump of which the displacement volume is varied as a function of tilt angle. The displacement volume is controlled by a regulator 41. Although not shown, the regulator 41 has a tilting cylinder and a forward-reverse selector valve that is switched in response to a forward reverse switching signal from the main controller 100. A control pressure is supplied through the forward reverse selector valve to the tilting cylinder, so that the displacement volume is controlled as a function of control pressure, and the operating direction of the tilting cylinder is controlled in response to switching of the forward reverse selector valve, and thus the tilting direction of the HST pump 40 is controlled.

The HST motor 50 is a swash-plate or bent-axis, variable displacement hydraulic motor of which the displacement volume is varied as a function of tilt angle. The main controller 100 outputs a control signal to a motor regulator 51 to control the displacement volume of the HST motor 50 (motor capacity). When an actual rotation speed of the engine 190 is lower than a required rotation speed of the engine 190 and a difference between the actual and required rotation speeds is large, the main controller 100 controls the displacement volume to be smaller than that when the difference is smaller in order to prevent engine stalling. In the following, an actual rotation speed of the engine 190 will be sometimes referred to as an actual engine rotation speed Na and a required rotation speed of the engine 190 is sometimes referred to as a required engine rotation speed Nr.

In this manner, the present embodiment employs the input-split transmission 3. The input-split transmission 3 is configured such that the HST motor 50, which is connected via the hydraulic oil circuit to the HST pump 40 coupled to the planetary gear mechanism 140, is coupled to the transmission output shaft 150 at a constant speed ratio. The output torque of the engine 190 is transferred via the planetary gear mechanism 140 to the HST 31 and the mechanical transmission unit 32 in parallel, to drive the wheels 113.

The main controller 100 is connected to the forward reverse shift lever 164 making an instruction to move the vehicle in the forward direction or the reverse direction, or indicating the travel direction of the wheel loader. The main controller 100 detects an instruction signal (i.e. forward signal/neutral signal/reverse signal) indicative of an operated position (forward (F)/neutral (N)/reverse (R)) of the forward reverse shift lever 164. Upon the forward reverse shift lever 164 being shifted to the forward (F) position, the main controller 100 outputs a control signal to the transmission control device 20 to engage the forward clutch 18 of the transmission 3. Upon the forward reverse shift lever 164 being shifted to the revere (R) position, the main controller 100 outputs a control signal to the transmission control device 20 to engage the reverse clutch 19 of the transmission 3.

In the transmission control device 20, upon reception of a control signal to engage the forward clutch 18 or the reverse clutch 19, a clutch control valve (not shown) installed in the transmission control device 20 is operated to engage the forward clutch 18 or the reverse clutch 19, and thus the travel direction of the work vehicle is switched to the forward direction or the reverse direction. Upon the forward reverse shift lever 164 being shifted to the neutral (N) position, the controller 100 outputs a control signal to the transmission control device 20 to release the forward clutch 18 and the reverse clutch 19. Thus, the forward clutch 18 and the reverse clutch 19 are brought to the release state, so that the transmission 3 results in the neutral state.

The main controller 100 is connected to a clutch sensor 131 and a vehicle speed sensor 132. The clutch sensor 131 detects whether or not the forward clutch 18 and the reverse clutch 19 are in the engagement state, and the clutch sensor 131 outputs, to the main controller 100, an on signal if the clutches 18, 19 are in the engagement state and an off signal if the clutches 18, 19 are in the release state. The vehicle speed sensor 132 detects the rotation speed of the output shaft 4 of the transmission 3 which is a physical quantity corresponding to a vehicle speed, and the vehicle speed sensor 132 outputs a detection signal to the main controller 100. It is noted that when the forward clutch 18 is in the engagement state and the reverse clutch 19 is in the release state, the output shaft 4 of the transmission 3 rotates in one direction to move the vehicle forward. At this time, the vehicle speed sensor 132 outputs a positive output value to the main controller 100. When the reverse clutch 19 is in the engagement state and the forward clutch 18 is in the release state, the output shaft 4 of the transmission 3 rotates in the other direction to reverse the vehicle. At this time, the vehicle speed sensor 132 outputs a negative output value to the main controller 100.

As illustrated in FIG. 2, the wheel loader includes the main pump 11, the accessory pump 12, a plurality of hydraulic cylinders, a control valve 21, and a steering valve 85. The control valve 21 controls the flow of pressure oil for the hydraulic cylinders (115, 117) driving the working device. The steering valve 85 controls the flow of pressure oil for the hydraulic cylinder (116) driving a travel device. The plurality of hydraulic cylinders includes the arm cylinder 117 driving the arm 111, the bucket cylinder 115 driving the bucket 112, and the steering cylinder 116 moving the front frame 110 to be bent relative to the rear frame 120. The main pump 11 is driven by the engine 190 to suck hydraulic oil from a hydraulic oil tank and to discharge the hydraulic oil as pressure oil.

The pressure oil discharged from the main pump 11 is supplied through the control valve 21 to the arm cylinder 117 and/or the bucket cylinder 115, so that the arm 111 and the bucket 112 are driven by the arm cylinder 117 and the bucket cylinder 115. The control valve 21 is operated by a pilot pressure output from the operation signal output device 30, and controls the flows of pressure oil from the main pump 11 to the arm cylinder 117 and the bucket cylinder 115. In this manner, the arm cylinder 117 and the bucket cylinder 115 forming part of the working device are driven by the pressure oil discharged from the main pump 11.

The pressure oil discharged from the main pump 11 is supplied through the steering valve 85 to a pair of left and right steering cylinders 116, so that the front frame 110 is steered to be bent relative to the rear frame 120 in the right or left direction by the pair of left and right steering cylinders 116. The steering valve 85 is operated by a pilot pressure output from the steering signal output device 43, and controls the flow of pressure oil from the main pump 11 to the steering cylinder 116. In this manner, the steering cylinder 116 forming part of the travel device is driven by the pressure oil discharged from the main pump 11.

The accessory pump 12 is driven by the engine 190 to suck hydraulic oil from the hydraulic oil tank and to discharge the hydraulic oil as pressure oil. The accessory pump 12 supplies the hydraulic oil to a fan motor 26 through a priority valve 33 and a fan drive system 34. The fan motor is one of a plurality of auxiliary machines. The fan motor 26 is a drive source to drive a fan blowing cooling air toward a radiator (not shown) for the engine 190. The fan drive system 34 controls the amount of hydraulic oil supplied to the fan motor 26.

The hydraulic oil discharged from the accessory pump 12 is also supplied to the operation signal output device 30 and the steering signal output device 43 which are auxiliary machines. The operation signal output device 30 reduces the pressure of the pressure oil discharged from the accessory pump 12 and outputs a pilot pressure according to the lever manipulated variable to a pilot-pressure receiving portion of the control valve 21. The steering signal output device 43 reduces the pressure of the pressure oil discharged from the accessory pump 12 and outputs a pilot pressure according to the steering-wheel manipulated variable to a pilot-pressure receiving portion of the steering valve 85. In this manner, the fan motor 26, the operation signal output device 30 and the steering signal output device 43, which are auxiliary machines are driven by the pressure oil discharged from the accessory pump 12.

The priority valve 33 is connected to the control valve 21 through a merging line 35. It is noted that the merging line 35 is not necessarily linked to the control valve 21, and may be configured to be linked such that a valve is separately installed on a supply line between the control valve 21 and the arm cylinder 117.

The priority valve 33 is switched between a normal position and a merging position, the normal position being to direct the pressure oil discharged from the accessory pump 12, toward the fan motor 26 via the fan drive system 34, the merging position being to direct the pressure oil toward the arm cylinder 117 via the control valve 21. The priority valve 33 is controlled based on the control signal from the main controller 100.

The priority valve 33 is mounted with a solenoid (not shown), so that the solenoid is energized based on the control signal from the main controller 100 to switch the priority valve 33 between the normal position and the merging position. When the priority valve 33 is switched to the merging position, all of hydraulic oil discharged from the accessory pump 12 is not directed to the control valve 21, but instead a portion of the hydraulic may be directed to the control valve 21.

Figure 4:
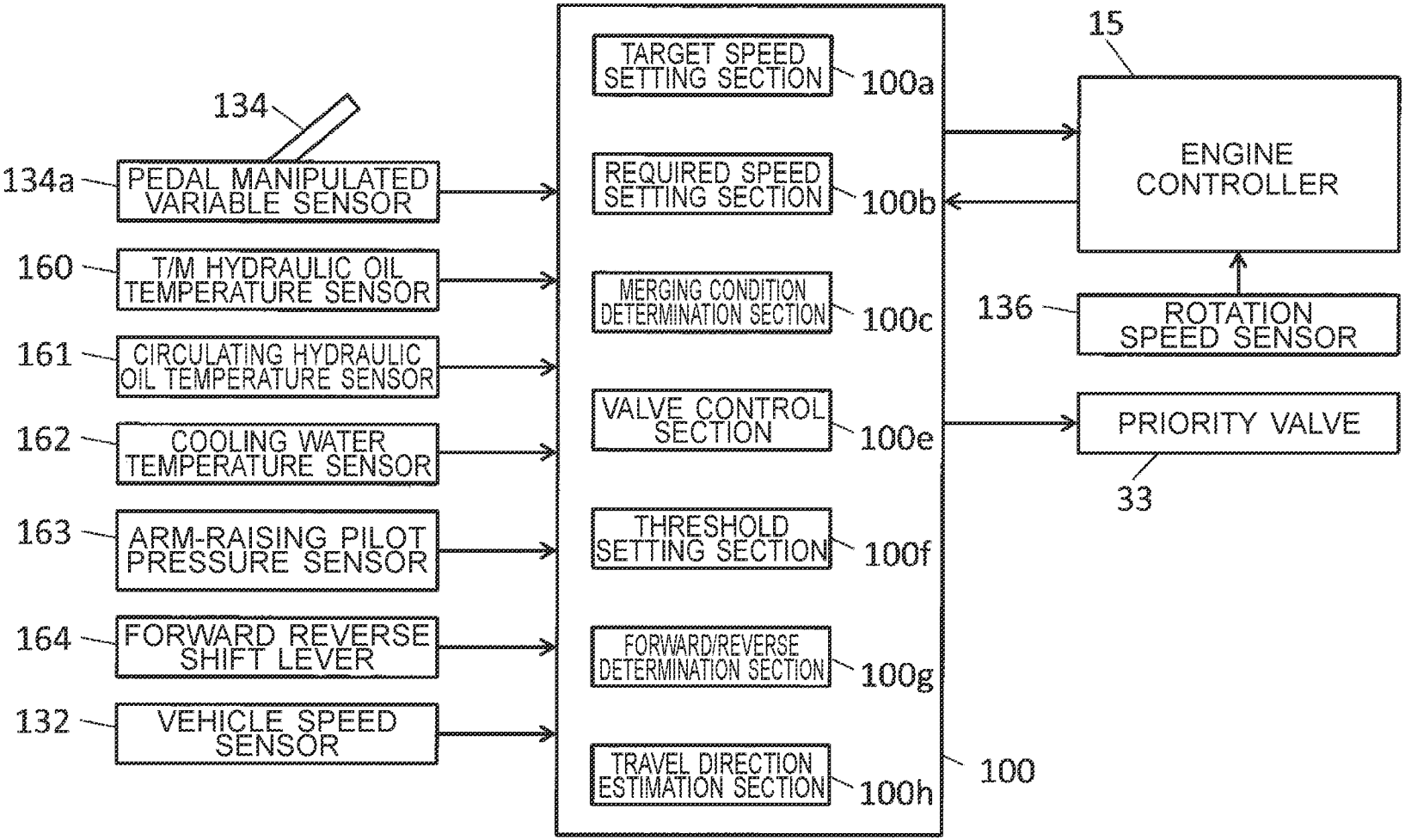
FIG. 4 is a functional block diagram of a main controller.

FIG. 4 is a functional block diagram of the main controller 100. The main controller 100 functionally includes a target speed setting section 100*a*, a required speed setting section 100*b*, a merging condition determination section 100*c*, a valve control section 100*e*, a threshold setting section 100*f*, a forward/reverse determination section 100*g*, and a travel direction estimation section 100*h*.

A pedal manipulated variable sensor 134*a* is connected to the main controller 100. The pedal manipulated variable sensor 134*a* detects the degree of depression of an accelerator pedal 134 and then outputs a detection signal to the main controller 100. The target speed setting section 100*a* sets a target rotation speed of the engine 190 according to the manipulated variable of the accelerator pedal 134 detected by the pedal manipulated variable sensor 134*a*. A target rotation speed of the engine 190 will be hereafter referred sometimes to as a "target engine rotation speed Nt".

Figure 5:
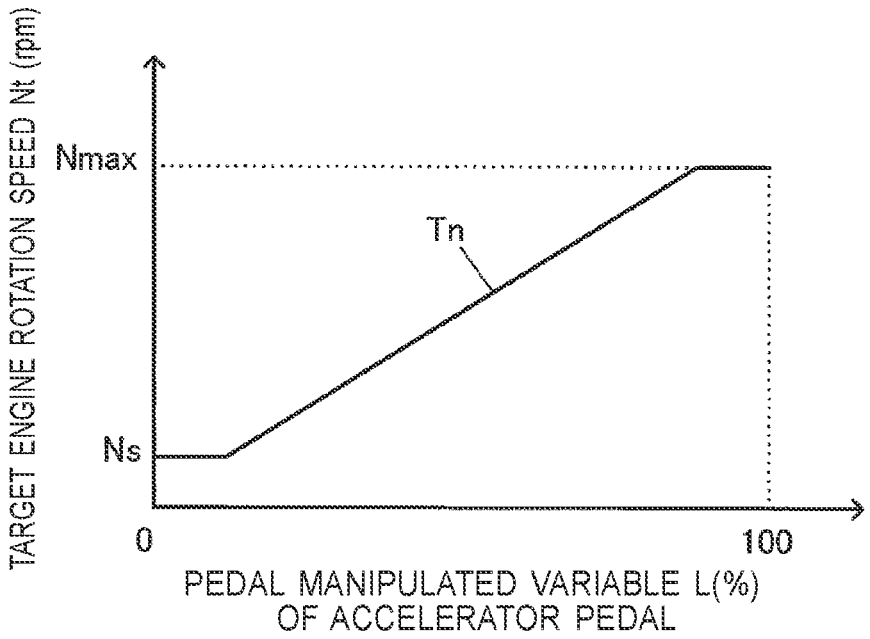
FIG. 5 is a graph showing the relationship between the manipulated variable L of an accelerator pedal and the target engine rotation speed Nt.

FIG. 5 is a graph showing the relationship between the manipulated variable L of the accelerator pedal 134 and the target engine rotation speed Nt. The storage device of the main controller 100 stores the table of target engine rotation speed characteristics Tn shown in FIG. 5. The target speed setting section 100*a* looks up the characteristics Tn table to set a target engine rotation speed Nt according to the manipulated variable L detected by the pedal manipulated variable sensor 134*a*. A target engine rotation speed Nt in non-operation (0%) of the accelerator pedal 134 is set to a low idle speed Ns. The target engine rotation speed Nt increases with an increase in the pedal manipulated variable L of the accelerator pedal 134. A target engine rotation speed Nt in pedal maximum depression (100%) is set to a rated rotation speed Nmax at rated point.

The required speed setting section 100*b* shown in FIG. 4 corrects the target engine rotation speed Nt set at the target speed setting section 100*a*, on the basis of the operating state of the wheel loader with a view to a reduction in fuel consumption and the like. Then, the required speed setting section 100*b* sets the corrected target engine rotation speed Nt as a required engine rotation speed Nr. It is noted that the amount of correction may be determined as zero and the target engine rotation speed Nt may possibly be set as a required engine rotation speed Nr without any change.

The main controller 100 outputs a control signal corresponding to the required engine rotation speed Nr to the engine controller 15. The engine controller 15 is connected to a rotation speed sensor 136. The rotation speed sensor 136 detects an actual engine rotation speed Na and then outputs a detection signal to the engine controller 15. Note that the engine controller 15 outputs information on actual engine rotation speeds Na to the main controller 100. The engine controller 15 makes a comparison between the required engine rotation speed Nr from the main controller 100 and the actual engine rotation speed Na detected by the rotation speed sensor 136. And, the engine controller 15 controls a fuel injection device 190*a* (see FIG. 2) such that the actual engine rotation speed Na reaches the required engine rotation speed Nr.

The main controller 100 is connected to a T/M hydraulic oil temperature sensor 160, a circulating hydraulic oil temperature sensor 161 and a cooling water temperature sensor 162. The T/M hydraulic oil temperature sensor 160 detects a temperature Tt of the hydraulic oil in the transmission 3, and then outputs a detection signal to the main controller 100. The circulating hydraulic oil temperature sensor 161 detects a temperature Tm of the hydraulic oil that circulates throughout the hydraulic oil circuit after being discharged from the main pump 11, and then outputs a detection signal to the main controller 100. The cooling water temperature sensor 162 detects a temperature Tw of cooling water, and then outputs a detection signal to the main controller 100.

The main controller 100 is connected to a plurality of pilot pressure sensors including an arm-raising pilot pressure sensor 163. The arm-raising pilot pressure sensor 163 detects a pressure that is output from the operation signal output device 30 and then acts on the pilot-pressure receiving portion of the control valve 21 (arm-raising pilot pressure P). Then, the arm-raising pilot pressure sensor 163 outputs a detection signal to the main controller 100. That is, the arm-raising pilot pressure sensor 163 is a device to detect the lever manipulated variable of the arm operating device.

Figure 6:
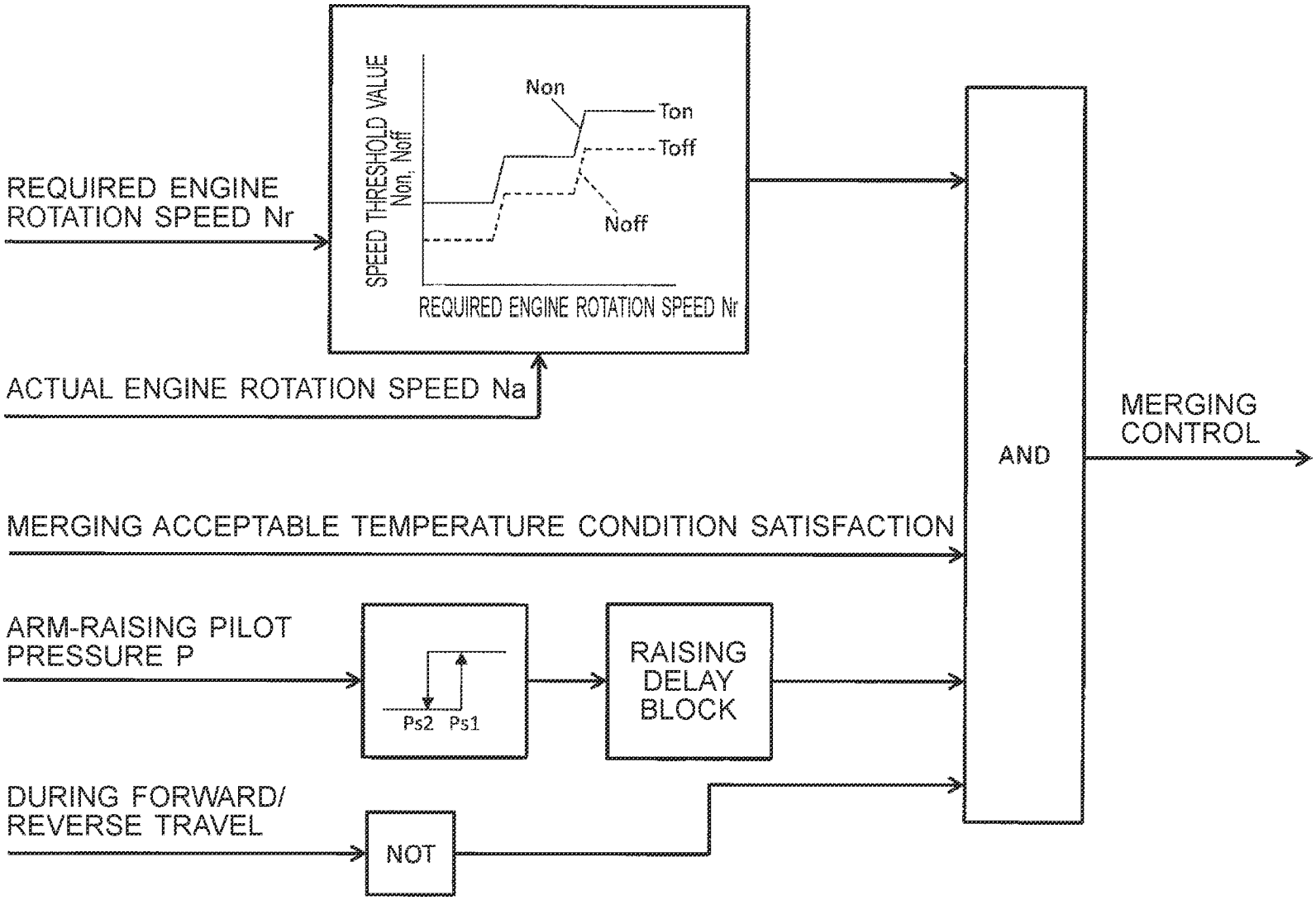
FIG. 6 is a block diagram describing the functions of a merging condition determination section.

FIG. 6 is a block diagram explaining the functions of the merging condition determination section 100*c*, and the conditions for enabling the merging of flows and the conditions for disabling the merging of flows are described with reference to FIG. 6.

The merging condition determination section 100*c* determines that the merging-enabling conditions are met, if all the following enabling single-conditions 1 to 4 are satisfied.

(Enabling Single-Condition 1)

An actual engine rotation speed Na is equal to or higher than a speed threshold value Non set based on the required engine rotation speed Nr.

(Enabling Single-Condition 2)

Merging acceptable temperature conditions are met.

(Enabling Single-Condition 3)

Since the arm-raising pilot pressure P became equal to or higher than a pressure threshold value Ps1 (P≥Ps1), a fixed time period ts has elapsed (measurement time t≥ts) without the arm-raising pilot pressure P decreasing to be lower than a pressure threshold value Ps2.

(Enabling Single-Condition 4)

Forward reverse switching operation is not in process.

The merging condition determination section 100*c* determines that the merging-disabling conditions are met, if any of the following disabling single-conditions 1 to 4 is satisfied.

(Disabling Single-Condition 1)

The actual engine rotation speed Na is equal to or lower than a speed threshold value Noff set based on the required engine rotation speed Nr.

(Disabling Single-Condition 2)

The merging acceptable temperature conditions are not met.

(Disabling Single-Condition 3)

The arm-raising pilot pressure P is lower than a pressure threshold value Ps2 (P<Ps2), or alternatively after the arm-raising pilot pressure P became equal to or higher than a pressure threshold value Ps1 (P≥Ps1), a fixed time period ts does not elapse (measurement time t<ts) without the arm-raising pilot pressure P decreasing to be lower than a pressure threshold value Ps2.

(Disabling Single-Condition 4)

Forward reverse switching operation is in process.

The speed threshold values Non, Noff in the enabling single-condition 1 and the disabling single-condition 1 are described. The storage device of the controller 100 stores speed threshold tables Ton, Toff in conformity with the required engine rotation speeds Nr. The speed threshold tables Ton, Toff show characteristics of increasing stepwise (in three stages in the present embodiment) with an increase in the required engine rotation speed Nr. The threshold setting section 100*f* looks up the speed threshold table Ton to set a speed threshold value Non based on the required engine rotation speed Nr set at the required speed setting section 100*b*. The threshold setting section 100*f* looks up the speed threshold table Toff to set a speed threshold value Noff based on the required engine rotation speed Nr set at the required speed setting section 100*b*.

Figure 7:
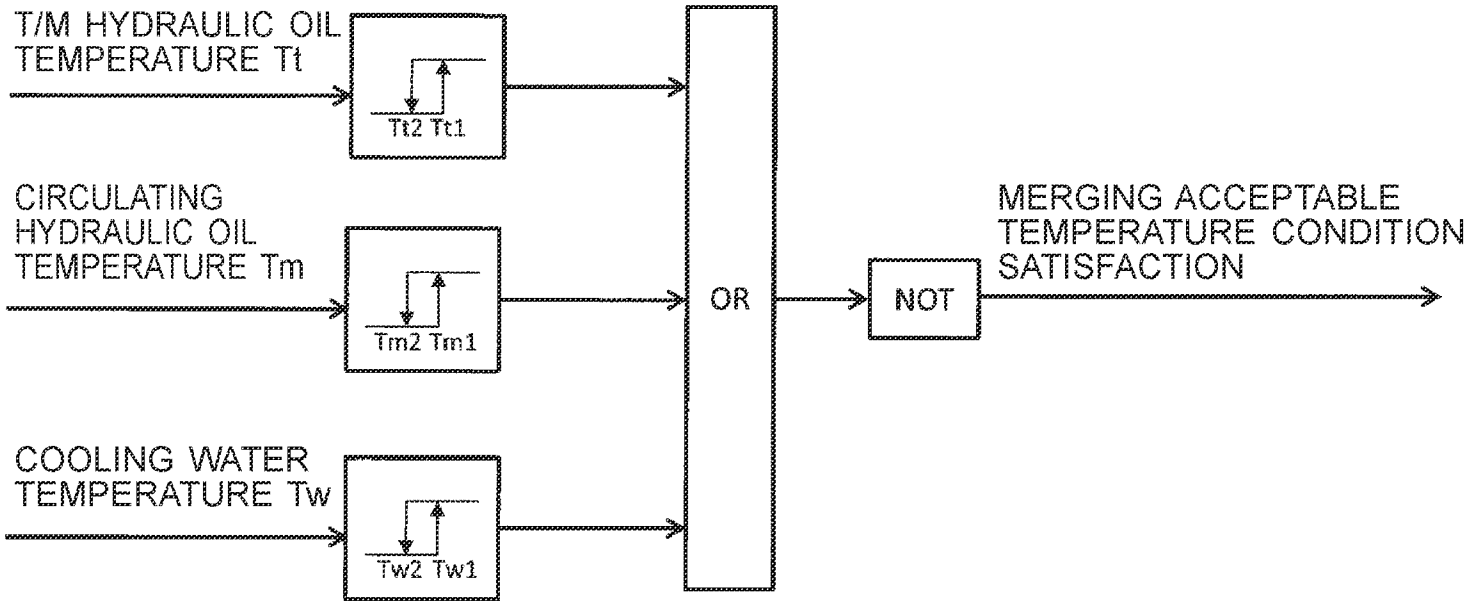
FIG. 7 is a block diagram describing the merging acceptable temperature conditions.

The merging acceptable temperature conditions in the enabling single-condition 2 and the disabling single-condition 2 are described with reference to FIG. 7. FIG. 7 is a block diagram explaining the merging acceptable temperature conditions. The merging condition determination section 100*c* determines that the merging acceptable temperature conditions are not met, if any of the following temperature single-conditions 1 to 3 is satisfied. The merging condition determination section 100*c* determines that the merging acceptable temperature conditions are met, if all the following temperature single-conditions 1 to 3 are not satisfied.

(Temperature Single-Condition 1)

A temperature Tt of the hydraulic oil in the transmission 3 is equal to or higher than a temperature threshold value Tt1, and, after the temperature Tt has reached equal to or higher than the temperature threshold value Tt1, the temperature Tt is not equal to or lower than a temperature threshold value Tt2.

The magnitude relationship between the temperature threshold Tt1 and the temperature threshold value Tt2 is Tt1>Tt2.

(Temperature Single-Condition 2)

A temperature Tm of the hydraulic oil, which circulates throughout the hydraulic oil circuit after being discharged from the main pump 11, is equal to or higher than a temperature threshold value Tm1, and, after the temperature Tm has reached equal to or higher than the temperature threshold value Tm1, the temperature Tm is not equal to or lower than a temperature threshold Tm2.

The magnitude relationship between the temperature threshold Tm1 and the temperature threshold value Tm2 is Tm1>Tm2.

(Temperature Single-Condition 3)

A temperature Tw of cooling water is equal to or higher than a temperature threshold Tw1, and, after the temperature Tw has reached equal to or higher than the temperature threshold value Tw1, the temperature Tw is not equal to or lower than a temperature threshold value Tw2.

The magnitude relationship between the temperature threshold Tw1 and the temperature threshold value Tw2 is Tw1>Tw2.

For the temperature threshold values Tt1, Tt2, Tm1, Tm2, Tw1, Tw2, for example, temperatures of the order ranging from 90° C. to 110° C. are predefined with consideration given to a maximum operating temperature of each fluid, and the temperatures are stored in the storage device of the main controller 100.

The pressure threshold values Ps1, Ps2 and the fixed time periods is in the enabling single-condition 3 and the disabling single-condition 3 are described. The storage device of the main controller 100 stores the predetermined pressure threshold values Ps1, Ps2. The pressure threshold value Ps1 is a threshold value for determining whether or not the arm-raising operation has been performed. If the arm-raising pilot pressure P is equal to or higher than the pressure threshold Ps1, the merging condition determination section 100*c* determines that the arm-raising operation is performed. If the arm-raising pilot pressure P is lower than the pressure threshold Ps1, the merging condition determination section 100*c* determines that the arm-raising operation is not performed. The pressure threshold value Ps2 is a threshold value for determining whether or not the lever of the arm operating device is moved back to the neutral position after the arm-raising operation. If the arm-raising pilot pressure P is equal to or higher than the pressure threshold Ps2, the merging condition determination section 100*c* determines that the arm-raising operation is ongoing. If the arm-raising pilot pressure P is lower than the pressure threshold Ps2, the merging condition determination section 100*c* determines that the lever of the arm operating device has been moved back to the neutral position.

The fixed time period ts is preset, for example, at a given value of the order ranging from 0.5 sec. to 1 sec., which is stored in the storage device of the main controller 100. The time elapsed between the arm-raising operation and digging into a natural ground 130 is measured by tests using actual machinery and/or the like, and a length of time longer than the measured time may be set as the fixed time period ts. It is noted that a too long fixed time period ts may delay the start timing of the merging control performed when the arm is raised during a forward travel toward the damp truck, that is, the start timing of an increase of the speed at which the arm is raised, and therefore the fixed time period ts may be preferably set at approximately 2 sec. to 3 sec. or less at the longest.

Upon the arm-raising pilot pressure P reaching equal to or higher than the pressure threshold value Ps1, the main controller 100 starts measuring time with a built-in timer. The raising delay block illustrated in FIG. 6 determines whether or not the fixed time period is has elapsed without the arm-raising pilot pressure P decreasing to be lower than the pressure threshold value Ps2 since the arm-raising pilot pressure P became equal to or higher than a pressure threshold value Ps1. If an affirmative determination is made in the above determination process, the raising delay block outputs a signal indicating that the enabling single-condition 3 is met. If a negative determination is made in the above determination process, the raising delay block outputs a signal indicating that the disabling single-condition 3 is met.

The determination during the forward reverse switching operation in the enabling single-condition 4 and the disabling single-condition 4 is described. The travel direction estimation section 100*h* illustrated in FIG. 4 estimates a travel direction of the wheel loader on the basis of a negative/positive output value indicative of a vehicle speed detected by the vehicle speed sensor 132. If the output value from the vehicle speed sensor 132 is a positive value, the travel direction estimation section 100*h* estimates that the travel direction of the wheel loader is the forward direction. If the output value from the vehicle speed sensor 132 is a negative value, the travel direction estimation section 100*h* estimates that the travel direction of the wheel loader is the reverse direction.

Figure 8:
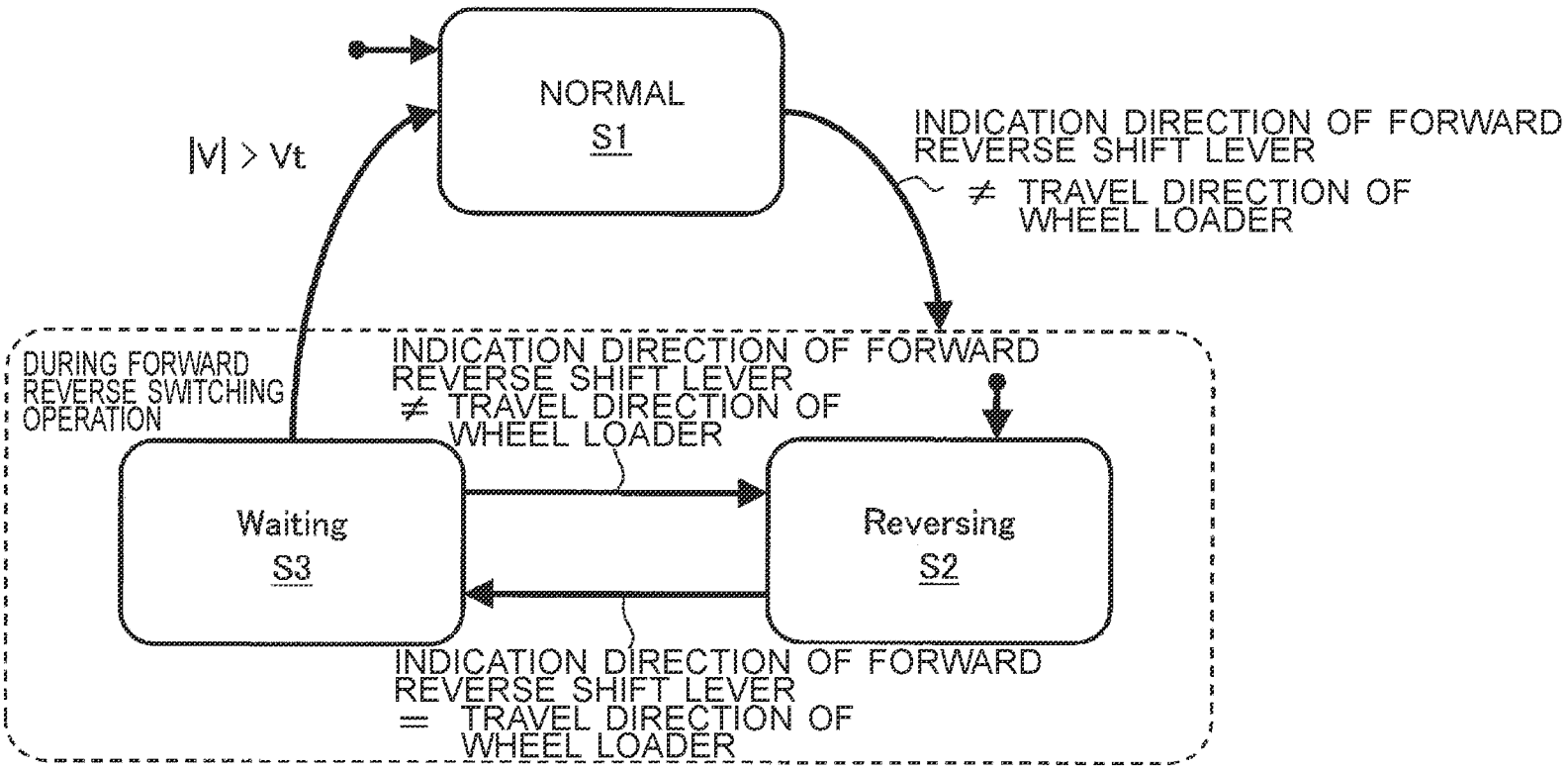
FIG. 8 is a state transition diagram describing a forward reverse switching operation determination.

FIG. 8 is a state transition diagram describing the forward reverse switching operation determination. The forward/reverse determination section 100*g* determines as follows whether or not the forward reverse switching operation is in process. In a normal state S1, when the indication direction of the forward reverse shift lever 164 and the travel direction of the wheel loader estimated at the travel direction estimation section 100*h* are opposite to each other, that is, do not match each other, the forward/reverse determination section 100*g* determines that the forward reverse switching operation is started. Thereby the state of the wheel loader makes a transition from the normal state S1 to a reversing state S2.

In the reversing state S2, when the indication direction of the forward reverse shift lever 164 and the travel direction of the wheel loader estimated at the travel direction estimation section 100*h* are the same, that is, match each other, the forward/reverse determination section 100*g* determines that waiting conditions are met, and a transition occurs from the revering state S2 to a waiting state S3. In the waiting state S3, the forward/reverse determination section 100*g* determines whether or not an absolute value |V| of the vehicle speed V detected by the vehicle speed sensor 132 is higher than a fixed value Vt. If the absolute value |V| of the vehicle speed V is equal to or lower than the fixed value Vt, the forward/reverse determination section 100*g* determines that the forward reverse switching operation is ongoing. If the absolute value |V| of the vehicle speed V is higher than the fixed value Vt, the forward/reverse determination section 100*g* determines that the forward reverse switching operation is completed. Upon completion of the forward reverse switching operation, the state of the wheel loader makes a transition from the waiting state S3 to the normal state S1. From the beginning to the completion of the forward reverse switching operation, the forward/reverse determination section 100*g* determines that the forward reverse switching operation is ongoing.

It is noted that, in the waiting state S3, when the indication direction of the forward reverse shift lever 164 and the travel direction of the wheel loader estimated at the travel direction estimation section 100*h* do not match each other, a transition occurs from the waiting state S3 to the reversing state S2.

Set for the fixed value Vt is a vehicle speed V which is obtained when the load torque of the transmission 3 is sufficiently reduced to cause less occurrence of a reduction in engine rotation speed after the indication direction of the forward reverse shift lever 164 and the travel direction of the wheel loader estimated at the travel direction estimation section 100*h* match each other. The fixed value Vt is preset, for example, at any given value equal to or higher than 5 km/h, which is stored in the storage device of the main controller 100.

Where the merging condition determination section 100*c* determines that the merging-enabling conditions are met, the valve control section 100*e* energizes the solenoid of the priority valve 33 to switch the priority valve 33 to the merging position. Where the merging condition determination section 100*c* determines that the merging-disabling conditions are met, the valve control section 100*e* de-energizes the solenoid of the priority valve 33 to switch the priority valve 33 to the normal position.

Figure 9:
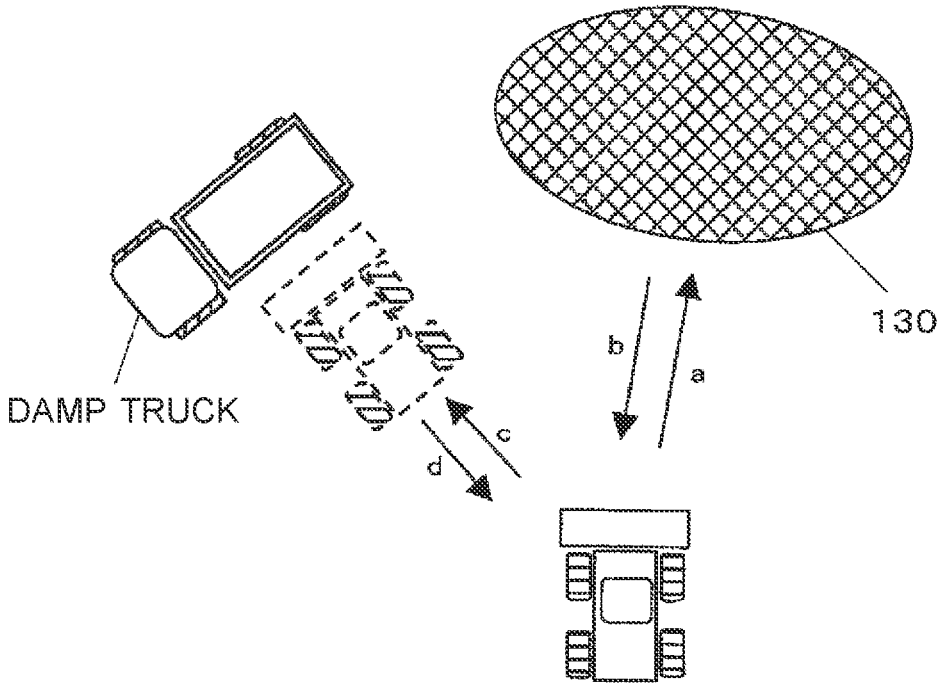
Figure 10:
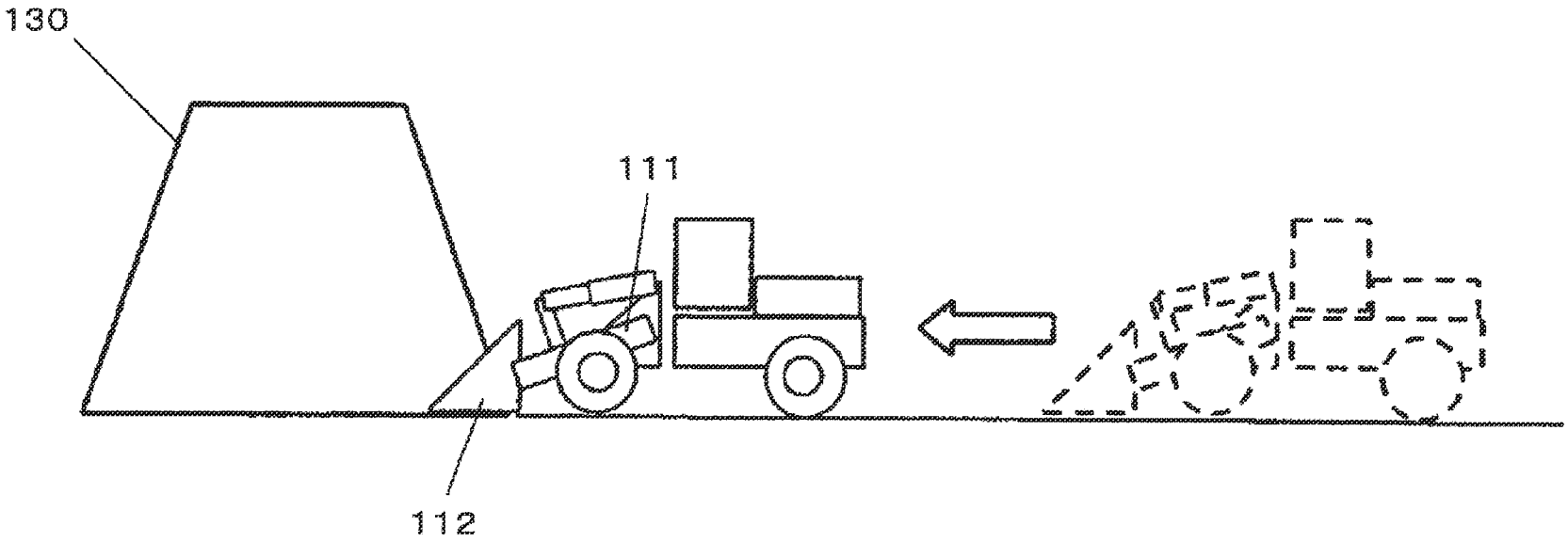
FIG. 10 is a diagram illustrating excavation of a wheel loader.

FIG. 9 is a diagram illustrating the V-shape loading which is one of methods of loading a damp truck with earth, sand and/or the like. FIG. 10 is a diagram illustrating excavation of the wheel loader. As illustrated in FIG. 9, in the V-shape loading, the wheel loader is moved forward toward the natural ground 130 such as earth, sand and/or the like as shown by arrow a.

As illustrated in FIG. 10, the excavation work is performed by causing the bucket 112 to dig into the natural ground 130, then, operating the bucket 112 before raising the arm 111, or alternatively simultaneously operating both the bucket 112 and the arm 111 and then raising only the arm 111 finally.

Upon completion of the excavation work, as shown by arrow b of FIG. 9, the wheel loader is temporarily moved rearward. As shown by arrow c, the wheel loader is moved forward toward the damp truck, and is stopped short of the damp truck to load the damp truck with the scooped-up earth, sand and/or the like. Then, as shown by arrow d, the wheel loader is moved rearward to the original position. This is the basic movements for the excavation and loading work in the V-shape loading.

In the present embodiment, if the merging-disabling conditions are met, the priority valve 33 is switched to the normal position. This enables less reduction in actual engine rotation speed Na. Advantageous effects according to the present embodiment will now be described in comparison with comparative examples.

Figure 11:
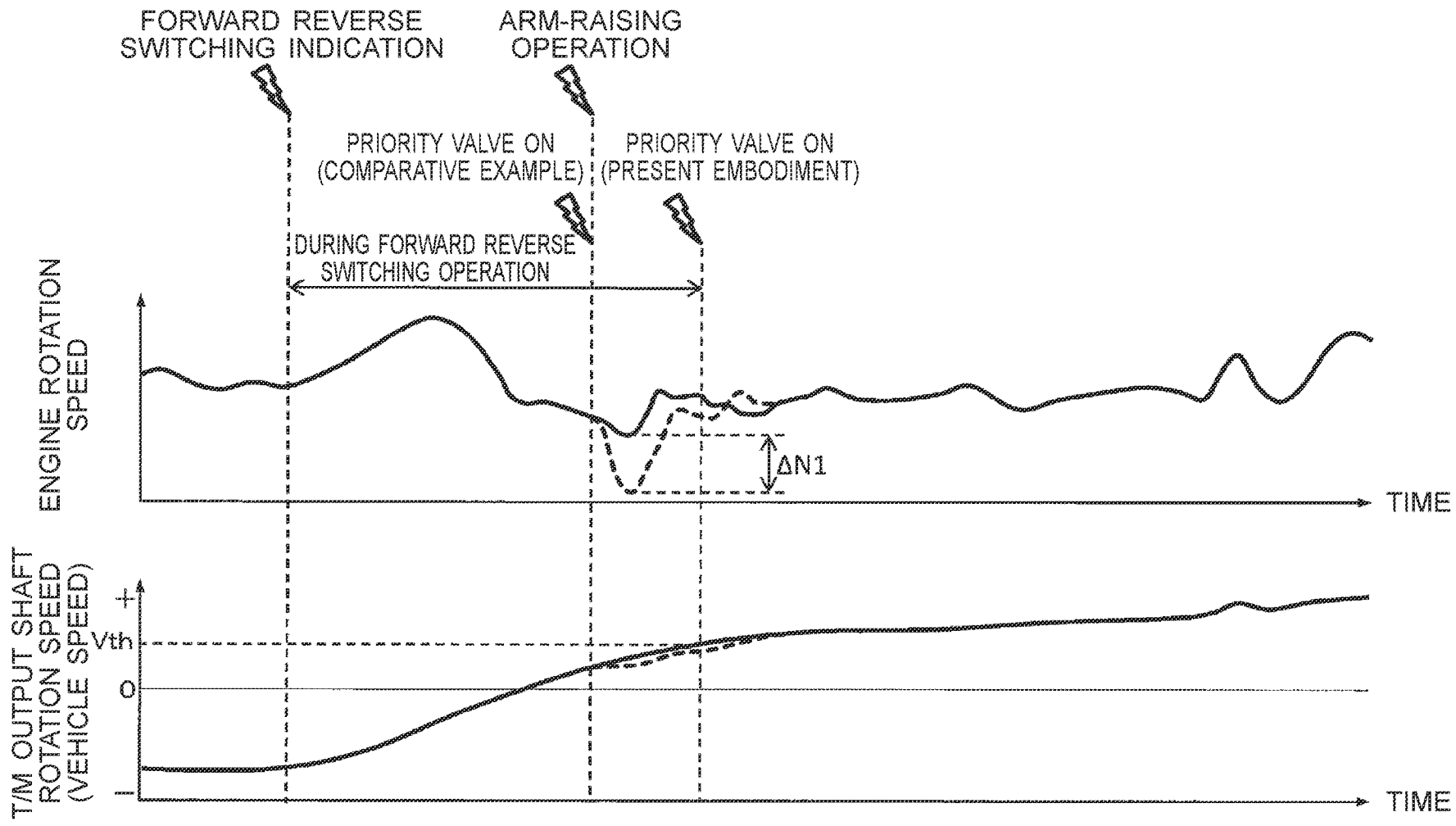
FIG. 11 is a diagram describing the behavior when the forward reverse switching operation is performed.

FIG. 11 is a diagram describing the behavior when the forward reverse switching operation is performed. In the figure, the solid line shows the behavior of the wheel loader according to the present embodiment and the broken line shows the behavior of a wheel loader according to a comparative example. The wheel loader according to the comparative example has an enabling single-condition 3C instead of the aforementioned enabling single-condition 3, and does not have the aforementioned enabling single-condition 4.

(Enabling Single-Condition 3C)

The arm-raising pilot pressure P is equal to or higher than the pressure threshold value Ps1 ($P \geq Ps1$).

Also, the wheel loader according to the comparative example has the enabling single-condition 3C instead of the aforementioned enabling single-condition 3, and does not have the aforementioned enabling single-condition 4.

(Disabling Single-Condition 3C)

The arm-raising pilot pressure P is lower than the pressure threshold value Ps2 ($P < Ps2$).

For forward travel of the reverse traveling wheel loader, the driver operates to return the accelerator pedal 134 and shift the forward reverse shift lever 164 from reverse to forward. Because of this, at the time of a shift from reverse to forward, the rearward inertial energy of the vehicle acts as load on the engine 190 via the mechanical transmission unit 32. Further, the driver has the work to load the dump truck in mind, and the driver operates the arm operating lever toward the raising side to raise the arm 111 when the shift from reverse to forward. At this time, in the comparative example, by the operation of raising the arm 111, the merging conditions are met and the priority valve 33 is set at the merging position, whereupon the loads of the main pump 11 and the accessory pump 12 for driving the arm 111 act on the engine 190. If, in this manner, the operations of switching the travel direction from reverse to forward and concurrently driving the front working device 119 (hereinafter referred to as a "traveling-switching combined operation") is performed, both the travel system and the working system are driven, which causes a lack of the required engine output torque, resulting in occurrence of "lug down".

A significant reduction of the actual engine rotation speed Na with respect to the required engine rotation speed Nr may possibly result in awkward or jerky movement of the vehicle to cause extreme discomfort to the driver. Also, slow acceleration after completion of the shift to forward may possibly cause extreme discomfort to the driver.

According to the present embodiment, the merging-disabling conditions are met during the forward reverse switching operation and therefore the priority valve 33 is set at the normal position, so that the load of the accessory pump 12 acting on the engine 190 can be reduced. As a result, a reduction of the actual engine rotation speed Na is inhibited. A minimum value difference (inhibited reduction amount) $\Delta N1$ in the actual engine rotation speed Na between the present embodiment and the comparative example is the order of several hundred rpm. In the present embodiment, the amount of reduction in the actual engine rotation speed Na can be minimized as compared with the comparative example, and therefore driver's discomfort may be mitigated.

Figure 12:
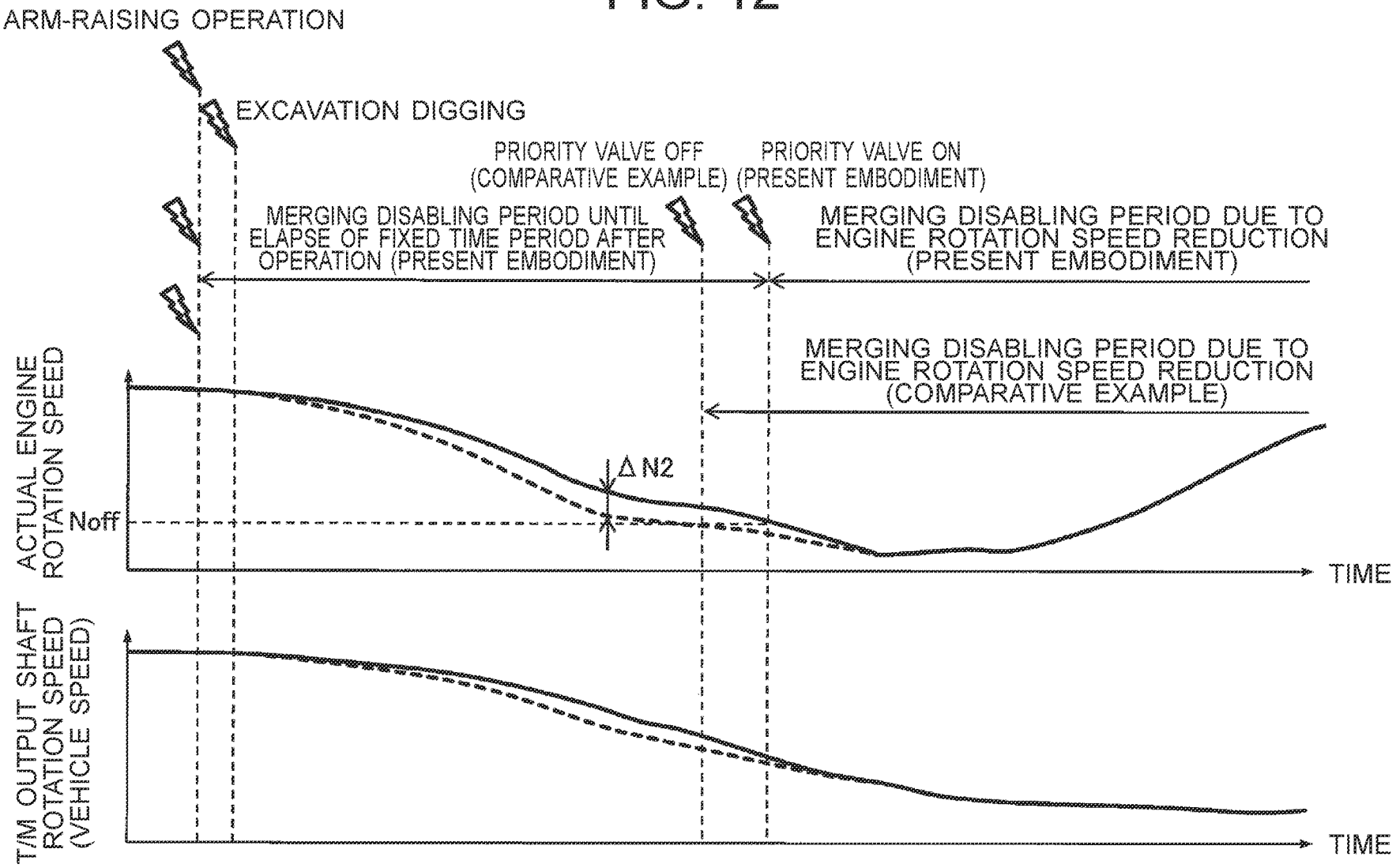
FIG. 12 is a diagram describing the behavior in the excavation operation.

FIG. 12 is a diagram illustrating the behavior when the excavation operation is performed. In the figure, the solid line shows the behavior of the wheel loader according to the present embodiment, and the broken line shows the behavior the wheel-loader according to the above-described comparative example.

For forward travel of the wheel loader toward the natural ground 130 and digging of the bucket 112 into the natural ground 130, the driver may operate the arm operating lever toward the raising side immediately before digging in order to raise the arm 111. At this time, in the comparative example, by the operation of raising the arm 111, the merging conditions are met and the priority valve 33 is set at the merging position. Because of this, when the bucket 112 digs into the natural ground 130, the load from the transmission 3 involved in the digging acts on the engine 190, and also the loads of the main pump 11 and the accessory pump 12 for driving and raising the arm 111 act on the engine 190. If, in this manner, the operation of driving the front working device 119 at the time of digging (hereinafter referred to as a "digging combined operation") is performed, both the travel system and the working system are driven, which causes a lack of the required engine output torque, resulting in occurrence of "lug down".

A significant reduction of the actual engine rotation speed Na with respect to the required engine rotation speed Nr may possibly result in awkward or jerky movement of the vehicle to cause extreme discomfort to the driver. Also, deceleration of the front working device 119 in the digging operation may possibly cause extreme discomfort to the driver. It is noted that, when the actual engine rotation speed Na reaches equal to or lower than the speed threshold value Noff, the priority valve 33 is switched to the normal position and therefore the load acting on the engine 190 is reduced.

In the present embodiment, because the merging-disabling conditions are met until the fixed time period is from the arm-raising operation elapses and thus the priority valve 33 is set at the normal position, a reduction in the load of the accessory pump 12 acting on the engine 190 is enabled. As a result, a reduction of the actual engine rotation speed Na is inhibited. A minimum value difference (inhibited reduction amount) ΔN2 in the actual engine rotation speed Na between the present embodiment and the comparative example is the order of several hundred rpm. In the present embodiment, the amount of reduction in the actual engine rotation speed Na can be minimized as compared with the comparative example, and therefore driver's discomfort may be mitigated.

It is noted that, as shown by arrow c in FIG. 9, where the wheel loader travels forward toward the dump truck and the arm-raising operation is performed during this forward travel, the merging-disabling period in which the merging control is not performed occurs, but this merging-disabling period is a slight time period (e.g., approximately one second), which is shorter than the time required to raise the arm 111 to a vertical position of the dump truck. Also, because of the pressure oil discharge from the main pump 11 even during the merging-disabling period, the operation of raising the arm 111 is being performed. Because of this, when approaching the dump truck, even if the timing to enter the merging control is delayed by approximately one second after the arm-raising operation, this will give a less feeling to the driver.

According to the above-described embodiment, the following advantageous effects can be provided.

(1) The main controller 100 switches the priority valve 33 to the normal position while the wheel loader is in the forward reverse switching operation. Specifically, when either of the forward direction and the reverse direction which is indicated by the forward reverse shift lever 164 and the travel direction of the wheel loader do not match each other, the main controller 100 holds the priority valve 33 in the normal position. Meanwhile, when either of the forward direction and the reverse direction which is indicated by the forward reverse shift lever 164 and the travel direction of the wheel loader match each other, and the arm operating device has been operated, the main controller 100 switches the priority valve 33 to the merging position. In consequence, as compared with the case where the merging control is executed when the forward reverse switching operation is performed, a reduction in engine rotation speed can be minimized and smooth movement of the wheel loader may be enabled, so that driver's discomfort can be mitigated.

(2) The main controller 100 holds the priority valve 33 in the normal position until the preset fixed time period is elapses after the arm 111 forming part of the working device is operated by the arm operating device. In consequence, where, in the excavation work, the arm operating lever is operated to the raising side and then digging into the natural ground 130 is performed, as compared with the case where the merging control is executed, a reduction in engine rotation speed can be minimized, and also smooth movement of the wheel loader can be enabled, thus mitigating driver's discomfort.

(3) The main controller 100 estimates a travel direction of the wheel loader on the basis of a negative/positive output value indicative of a vehicle speed detected by the vehicle speed sensor 132, and then, when the estimated travel direction and the direction indicated by the forward reverse shift lever 164 are opposite to each other, the main controller 100 determines that the forward reverse switching operation is started. Because the vehicle speed sensor 132 can be used to estimate a travel direction and the determination that the forward reverse switching operation is started can be made, the number of additional structural components can be minimized and increases in component count and cost can be minimized.

(4) When the direction indicated by the forward reverse shift lever 164 and the travel direction of the wheel loader match each other and also the absolute value |V| of the vehicle speed V detected by the vehicle speed sensor 132 is higher than the fixed value Vt, the main controller 100 determines that the forward reverse switching operation is completed. This enables a transfer to the merging control after the load torque of the transmission is reduced.

(5) In the present embodiment, where the arm-raising operation is performed during the forward travel of the wheel loader, without making determination whether or not the arm-raising operation is performed immediately before the digging into the natural ground 130 or whether or not the arm-raising operation is performed to move toward the damp truck, the merging control is configured to be not executed until the fixed time period elapses after the arm-raising operation in a uniform manner. Any device to detect a distance to a target, such as a millimeter-wave radar, a laser radar or the like, is not necessary, and therefore the component count and the cost can be reduced.

Modifications as described below fall within the scope of the present invention and one or more of example modifications may be combined with the foregoing embodiment.

(Example Modification 1)

Although the example where the travel direction of the wheel loader is estimated based on a positive/negative output value corresponding to the vehicle speed detected by the vehicle speed sensor 132 has been described in the above embodiment, the present invention is not limited to this example. The travel direction of the wheel loader may be estimated based on an engagement state of the clutch device 16. In this case, when the forward clutch 18 is in the engagement state and also the reverse clutch 19 is in the release state, the travel direction estimation section **100*h* estimates that the travel direction of the wheel loader is the forward direction. When the reverse clutch 19 is in the engagement state and also the forward clutch 18 is in the release state, the travel direction estimation section 100*h*** estimates that the travel direction of the wheel loader is the reverse direction.

(Example Modification 2)

Although the example where it is determined based on the lever manipulated variable in the arm operating device whether or not the arm 111 is being operated has been described in the above embodiment, the present invention is not limited to this example.

(Example Modification 2-1)

An angle detection device is provided to detect an angle of the arm 111, and based on a time rate of change in angle of the arm 111, or an angular speed, detected by the angle detection device, it is determined whether or not the arm 111 is being operated. In this case, the merging condition determination section 100*c* determines whether or not the following enabling single-condition 3B, instead of the aforementioned enabling single-condition 3, is satisfied.

(Enabling Single-Condition 3A)

The fixed time period ts is elapsed after a time rate of change in angle ω of the arm 111 reaches equal to or higher than a preset fixed value ωs.

The merging condition determination section 100*c* determines whether or not the following disabling single-condition 3A, instead of the aforementioned disabling single-condition 3, is satisfied.

(Disabling Single-Condition 3A)

The time rate of change in angle ω of the arm 111 is lower than a preset fixed value ωs, or alternatively, the fixed time period ts is not elapsed after the time rate of change in angle ω of the arm 111 reaches equal to or higher than the preset fixed value ωs.

(Example Modification 2-2)

A bottom pressure detection device may be provided to detect a bottom pressure of the arm cylinder 117, and it may be determined based on a time rate of change in bottom pressure Pt detected by the bottom pressure detection device whether or not the arm 111 is being operated. In this case, the merging condition determination section 100*c* determines whether or not the following enabling single-condition 3A, instead of the aforementioned enabling single-condition 3, is satisfied.

(Enabling Single-Condition 3A)

The fixed time period ts is elapsed after a time rate of change in bottom pressure Pt reaches equal to or higher than a predetermined fixed value Pts.

The merging condition determination section 100*c* determines whether or not the following disabling single-condition 3B, instead of the aforementioned disabling single-condition 3, is satisfied.

(Disabling Single-Condition 3B)

The time rate of change in bottom pressure Pt is lower than a predetermined fixed value Pts, or alternatively, the fixed time period ts is not elapsed after the time rate of change in bottom pressure Pt reaches equal to or higher than the predetermined fixed value Pts.

(Example Modification 3)

The merging-enabling conditions and the merging-disenabling conditions are not limited to the foregoing embodiment. For example, when all of the above-described enabling single-conditions 1 to 4 as well as the following enabling single-condition 5 and the following enabling single-condition 6 are satisfied, the merging-flow condition determination section 100*c* determines that the merging-enabling conditions are met.

(Enabling Single-Condition 5)

Excavation is not in process.

(Enabling Single-Condition 6)

The forward reverse shift lever 164 is switched to the forward position (F) or the neutral position (N).

Also, when any of these conditions, the aforementioned disabling single-conditions 1 to 4 as well as the following disabling single-condition 5 and the following disabling single-condition 6, is satisfied, the merging condition determination section 100*c* determines that the merging-disabling conditions are met.

(Disabling Single-Condition 5)

Excavation is in process.

(Disabling Single-Condition 6)

The forward reverse shift lever 164 is switched to the reverse position (R).

Whether or not excavation is in process is determined based on the discharge pressure of the main pump 11 by the main controller 100. The main controller 100 is connected to a discharge pressure detection device to detect a discharge pressure of the main pump 11. When the discharge pressure is equal to or higher than a preset fixed pressure, the main controller 100 determines that excavation is ongoing. When the discharge pressure is lower than the preset fixed pressure, the main controller 100 determines that excavation is not ongoing. The merging control is designed to be not executed during excavation, thereby reducing the load on the engine during excavation.

(Example Modification 4)

In the above embodiment, the instance where the condition for a transition from the waiting state S3 to the normal state S1 during the forward reverse switching operation is that the absolute value |V| of the vehicle value V exceeds the fixed value Vt has been described, but the present invention is not limited to this instance. Without regard for the vehicle speed V, when the time that elapsed after a transition from the reversing state S2 to the waiting state S3 exceeds a preset fixed time period tt, the transition from the waiting state S3 to the normal state S1 may be designed to occur. A time period to be set for the fixed time period tt is from when the indication direction of the forward reverse shift lever 164 and the travel direction of the wheel loader estimated by the travel direction estimation section 100*h* match each other, to when the load torque of the transmission 3 is sufficiently reduced to cause less occurrence of a reduction in engine rotation speed. The fixed time period tt is predefined at any given value of, for example, two seconds or longer, which is stored in the storage device of the main controller 100. In this manner, the forward/reverse determination section 100*g* may determine that the forward reverse switching operation is completed, when the indication direction of the forward reverse shift lever 164 and the travel direction of the wheel loader match each other, and also the preset fixed time period tt has elapsed after the matching of the travel direction of the wheel loader. Even in such a case, the same advantageous effects as the above embodiment can be provided.

(Example Modification 5)

In the above embodiment, the example where the merging-disabling period after the arm-raising operation is set at a constant fixed time period ts has been described, but the present invention is not limited to this example. The fixed time period ts may be varied based on the vehicle speed V detected by the vehicle speed sensor 132. In this case, the storage device of the main controller 100 stores a data table on characteristics of increasing the fixed time period ts as the vehicle speed is lower. The main controller 100 looks up the table to set a fixed time period ts according to the vehicle speed V. Even if a longer length of time is consumed from the arm-raising operation to the digging into the natural ground 130 due to a lower vehicle speed V than usual, the execution of the merging control can be prevented.

(Example Modification 6)

In the above embodiment, the example where, as the traveling-switching combined operation, the operation of raising the arm is performed during a transition from the reverse travel to the forward travel has been described, but the present invention is not limited to this example. For example, if the operation of raising the arm 111 is performed during a transition from the forward travel to the reverse travel, the same advantageous effects as the above are also provided.

(Example Modification 7)

Figure 13:
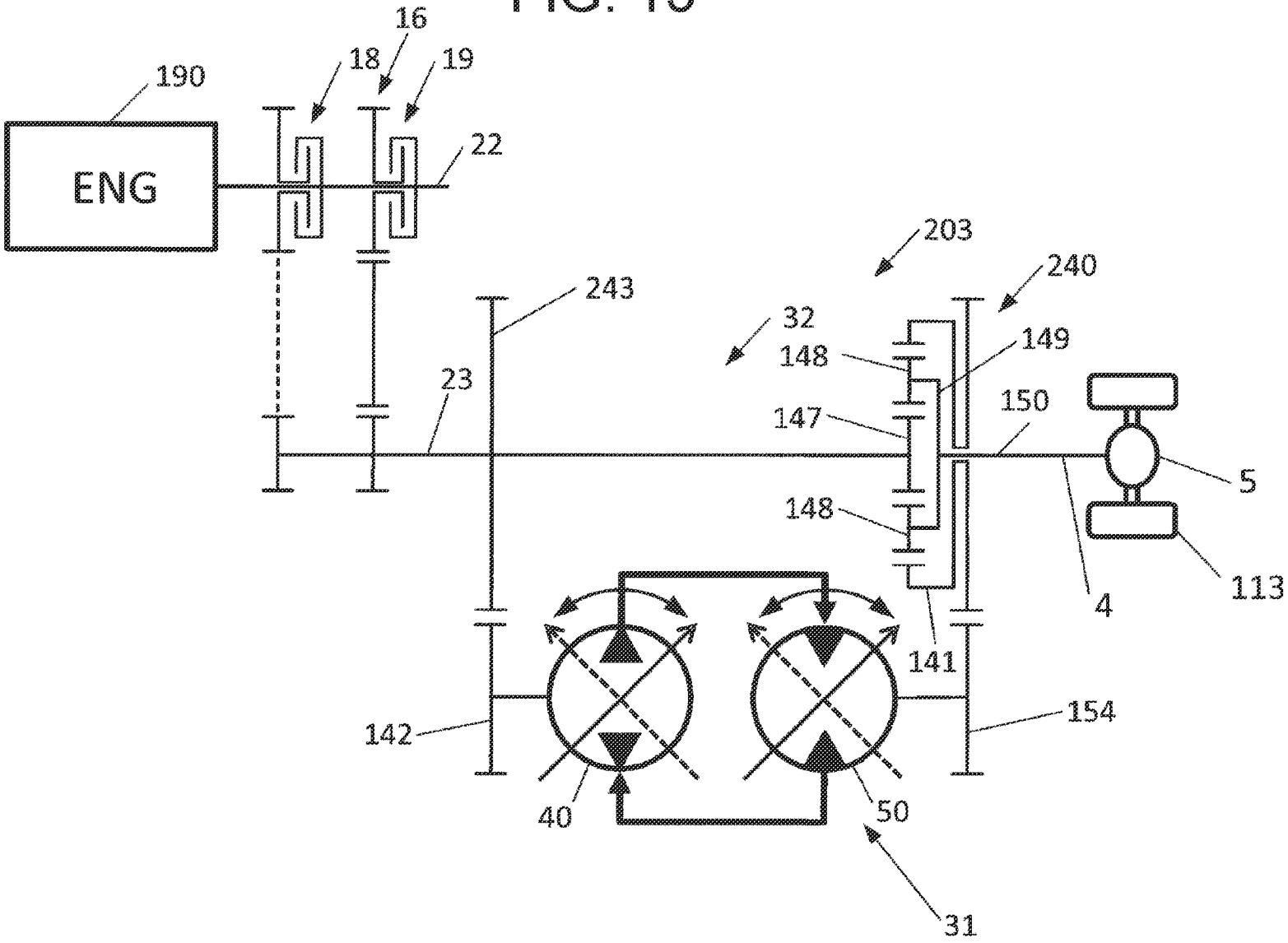
FIG. 13 is a schematic diagram illustrating the configuration of an output-split HMT according to an example modification.

In the above embodiment, the input-split transmission 3 (see FIG. 3) has been described as an example, but the present invention is not limited to this example. Instead of the input-split transmission 3, an output-split HMT 203 as illustrated in FIG. 13 may be employed. The output-split HMT 203 is configured such that the HST pump 40, which is connected via the hydraulic oil circuit to the HST motor 50 coupled to a planetary gear mechanism 240, is coupled to a transmission input shaft 23 at a constant speed ratio. In the example modification, the output torque of the engine 190 is transferred to the HST 31 and the mechanical transmission unit 32 in parallel, to drive the wheels 113 via the planetary gear mechanism 240.

As illustrated in FIG. 13, in the output-split HMT 203, the torque of the input shaft 23 is transferred through a gear 243 of the input shaft 23 and the pump input gear 142 to the HST 31. Also, the sun gear 147 of the planetary gear mechanism 240 is fixed to the input shaft 23. A plurality of the planet gears 148 meshes with the outer periphery of the sun gear 147. Each of the planet gears 148 is axially supported by the planetary carrier 149, and in turn the planetary carrier 149 is fixed to the output shaft 150. The output shaft 150 is connected to the above-described output shaft 4. The ring gear 141 meshes with the outer periphery of the planet gear group, and in turn the motor output gear 154 meshes with the outer periphery of the ring gear 141. The motor output gear 154 is fixed to the rotation shaft of the HST motor 50.

(Example Modification 8)

In the above embodiment, the wheel loader equipped with HMT has been described as an example, but the present invention is not limited to this example. The present invention is applicable to a hydraulic control device of a so-called torque converter driven work vehicle in which the engine output is transferred to the transmission via a torque converter which is a fluid clutch including a well-known impeller, a turbine and a stator. It is noted that, because of the HMT having the mechanical transmission, in the work vehicle in which the drive force of the engine 190 is transferred to the wheels, the load acting on the engine 190 in the forward reverse switching or the excavation digging has a larger influence as compared with the work vehicle including the torque converter. In the HMT driven type, the rate of increase in load on the engine when the merging control is executed during high travel load is higher than that in the torque converter driven type. Accordingly, the advantageous effects of the present invention are further effectively produced in the HMT driven type.

(Example Modification 9)

The arm operating device and/or the bucket operating device operating the control valve 21 may be of an electrical type instead of the hydraulic pilot type. The example of employing the forward reverse shift lever 164 as a forward reverse switching indication device has been described, but a forward reverse selector switch may be used.

(Example Modification 10)

In the above embodiment, the wheel loader has been illustrated as an example of the work vehicles, but the present invention is not limited to this, and the work vehicle may be another work vehicle such as a wheel excavator, a forklift, a telehandler, a lift truck or the like.

Although various embodiments and example modifications have been described, the present invention is not intended to be limited to those contents. Other aspects conceived within the technical sprit of the present invention also fall within the scope of the present invention.

REFERENCE SIGNS LIST

3 . . . Transmission
11 . . . Main pump
12 . . . Accessory pump
17 . . . Forward reverse shift lever (forward reverse operating device)
26 . . . Fan motor (auxiliary machine)
33 . . . Priority valve
100 . . . Main controller (control device)
**100*g*** . . . Forward/reverse determination section
**100*h*** . . . Travel direction estimation section
111 . . . Arm (working device)
132 . . . Vehicle speed sensor (vehicle speed detection device)
190 . . . Engine

The invention claimed is:

1. A work vehicle, comprising:

a main pump and an accessory pump that are driven by an engine;

a working device that is driven by pressure oil discharged from the main pump;

an operating device that operates the working device;

an auxiliary machine that is driven by pressure oil discharged from the accessory pump;

a priority valve that is switched between a normal position and a merging position, the normal position directing the pressure oil discharged from the accessory pump toward the auxiliary machine, the merging position directing the pressure oil discharged from the accessory pump toward the working device;

a forward reverse operating device that that provides an indication of a forward direction and a reverse direction the work vehicle is desired to travel; and a control device that holds the priority valve in the normal position in a first case when either the forward direction or the reverse direction which is indicated by the forward reverse operating device and a travel direction of the work vehicle do not match each other, and that switches the priority valve to the merging position in a second case when either the forward direction or the reverse direction which is indicated by the forward reverse operating device and the travel direction of the work vehicle match each other and the operating device is in an operated state.

2. The work vehicle according to claim 1, further comprising a transmission that makes switching between the forward direction and the reverse direction on the basis of the indication from the forward reverse operating device, wherein the control device has: a forward/reverse determination section that determines whether or not a forward reverse switching operation is ongoing, and a travel direction estimation section that estimates the travel direction of the work vehicle, and wherein, in the first case, the forward/reverse determination section determines that the forward reverse switching operation should start.

3. The work vehicle according to claim 2, further comprising:

a vehicle speed detection device that detects a vehicle speed of the work vehicle, wherein, in the second case, when the vehicle speed detected by the vehicle speed detection device is higher than a predetermined value, the forward/reverse determination section determines that the forward reverse switching operation is completed.

4. The work vehicle according to claim 2, wherein, in the second case, when the indication indicated by the forward reverse operating device and the travel direction of the work vehicle match each other for at least a preset fixed time period the forward/reverse determination section determines that the forward reverse switching operation is completed.

5. The work vehicle according to claim 1, wherein the control device holds the priority valve in the normal position until a preset fixed time period elapses after the working device starts to be operated by the operating device.

* * * * *